US012618254B2

(12) United States Patent
Beeny et al.

(10) Patent No.: US 12,618,254 B2
(45) Date of Patent: May 5, 2026

(54) PARKING BAYS HAVING A SLOPED FLOOR, AND PARKING APPARATUSES AND PARKING SYSTEMS INCLUDING SAME

(71) Applicant: Volley Automation, Inc., Denver, CO (US)

(72) Inventors: Lance Michael Beeny, Cove, UT (US); Stott D. Barwick, Centerville, UT (US); Merin Jay Swasey, North Logan, UT (US)

(73) Assignee: Volley Automation, Inc., Denver, CO (US)

( * ) Notice: Subject to any disclaimer, the term of this patent is extended or adjusted under 35 U.S.C. 154(b) by 484 days.

(21) Appl. No.: 18/479,494

(22) Filed: Oct. 2, 2023

(65) Prior Publication Data

US 2024/0110400 A1 Apr. 4, 2024

Related U.S. Application Data

(60) Provisional application No. 63/413,073, filed on Oct. 4, 2022.

(51) Int. Cl.
*E04H 6/42* (2006.01)

(52) U.S. Cl.
CPC ..... *E04H 6/424* (2013.01)

(58) Field of Classification Search
CPC .. E04H 6/424; E04H 6/34; E04H 6/36; E04H 6/38
See application file for complete search history.

(56) References Cited

U.S. PATENT DOCUMENTS

| | | | | |
|---|---|---|---|---|
| 4,641,994 | A | 2/1987 | Hankison | |
| 8,734,078 | B2 | 5/2014 | Benedict et al. | |
| 9,328,526 | B2 * | 5/2016 | Shani | E04H 6/424 |
| 9,416,554 | B2 | 8/2016 | Wastel | |
| 11,192,763 | B2 * | 12/2021 | Kritzer | B66F 7/0683 |
| 11,976,493 | B2 * | 5/2024 | Ishida | B62D 63/04 |
| 2017/0226764 | A1 | 8/2017 | Nussbaum | |
| 2022/0228391 | A1 * | 7/2022 | Ishida | B62D 63/04 |
| 2022/0333396 | A1 * | 10/2022 | Dauber | E04H 6/424 |

FOREIGN PATENT DOCUMENTS

| | | | |
|---|---|---|---|
| CN | 102312587 | A | 1/2012 |
| CN | 113404356 | A | 9/2021 |
| CN | 114934705 | A | 8/2022 |
| CN | 217205661 | U | 8/2022 |
| CN | 217260394 | U | 8/2022 |

OTHER PUBLICATIONS

Search Report and Written Opinion pertaining to Application No. PCT/US2023/034340 dated Jan. 22, 2024, 14 pages.

* cited by examiner

*Primary Examiner* — Jonathan Snelting
(74) *Attorney, Agent, or Firm* — Dinsmore & Shohl LLP

(57) ABSTRACT

A parking bay comprises a front wall comprising a front opening formed in the front wall and sized to accommodate a width of a vehicle; a rear wall opposite the front wall, the rear wall comprising a rear opening formed in the rear wall and sized to accommodate the width of the vehicle; a pair of side walls extending between the front wall and the rear wall; and a sloped floor provided between the front wall and the rear wall and defining a tray-receiving opening sized to contain a tray, wherein the sloped floor comprises an upper surface defining a slope between the front wall and the rear wall.

20 Claims, 8 Drawing Sheets

PARKING BAYS HAVING A SLOPED FLOOR, AND PARKING APPARATUSES AND PARKING SYSTEMS INCLUDING SAME

CROSS-REFERENCE To RELATED APPLICATION

This application claims the benefit of co-pending U.S. Provisional Patent Application Ser. No. 63/413,073 filed Oct. 4, 2022, which is hereby incorporated by reference in its entirety including the drawings.

TECHNICAL FIELD

The present specification generally relates to automated parking systems and, more specifically, automated parking systems which address vehicles not placed into a secured position such as, for example, a parking gear.

BACKGROUND

Unsecured vehicles rolling forward and backward while being transported within automated parking systems is a recurring problem within the industry. When a vehicle rolls backward or forward while in transit, the vehicle may collide with other vehicles stored in the system, with structure supporting the system, with system equipment itself, or even be damaged while moving within floors, between floors, and the like. In addition to potential damage to the vehicle itself, unintended movement of the vehicle may damage system equipment or building elements. Such incidents occur with some regularity and require significant direct human intervention to mitigate, which disrupts system operations until the resulting situation inside the system can be corrected, and any required repairs performed.

Automated parking system manufacturers have deployed a number of approaches in an attempt to limit the frequency of these sort of incidences caused by unsecured vehicles entering a parking system. However, previous methods utilized have practical limitations such as, for example, potential cost to system performance, situations which limit their effectiveness, and difficulty in complying with U.S. safety and Americans with Disabilities Act (ADA) requirements.

Accordingly, a need exists for improved parking bays that notify or otherwise alert an operator of a vehicle that the vehicle has not been placed into a secured position such as, for example, a parking gear.

SUMMARY

In embodiments, parking apparatuses, parking systems, and methods for parking a vehicle using the parking apparatuses and parking systems include a parking bay including a sloped floor defining a tray-receiving opening and a tray positionable within the tray-receiving opening. The tray includes an upper surface configured to have a slope corresponding to a slope of the sloped floor when positioned within the tray-receiving opening.

In an embodiment, a parking bay may comprise a front wall, a rear wall opposite the front wall, and a pair of side walls. In embodiments, the front wall may comprise a front opening formed in the front wall and sized to accommodate a width of a vehicle. In embodiments, the rear wall may comprise a rear opening formed in the rear wall and sized to accommodate the width of the vehicle. In embodiments, the pair of side walls may extend between the front wall and the rear wall. In embodiments, the parking bay may further comprise a sloped floor provided between the front wall and the rear wall. In embodiments, the sloped floor may define a tray-receiving opening sized to contain a tray. In embodiments, the sloped floor may comprise an upper surface defining a slope between the front wall and the rear wall.

In an embodiment, a parking system may comprise a tray comprising a first upper surface sized to accommodate a vehicle and a tray transportation mechanism comprising a lifting mechanism operable between a lowered position and a raised position. In embodiments, in the lowered position, the lifting mechanism may not engage the tray, and, in embodiments, in the raised position, the lifting mechanism may extend to raise the tray. In embodiments, the parking system may comprise a parking bay. In embodiments, the parking bay may comprise a front wall, a rear wall opposite the front wall, and a pair of side walls. In embodiments, the front wall may comprise a front opening formed in the front wall and sized to accommodate a width of a vehicle. In embodiments, the rear wall may comprise a rear opening formed in the rear wall and sized to accommodate the width of the vehicle. In embodiments, the pair of side walls may extend between the front wall and the rear wall. In embodiments, the parking bay may further comprise a sloped floor provided between the front wall and the rear wall. In embodiments, the sloped floor may define a tray-receiving opening sized to contain a tray. In embodiments, the sloped floor may comprise an upper surface defining a slope between the front wall and the rear wall.

In an embodiment, a method for orienting a tray within a parking bay on a slope may comprise positioning, by a tray transportation mechanism, a tray within a tray-receiving opening defined by a sloped floor of the parking bay and sized to contain the tray, wherein the sloped floor is provided between a front wall and a rear wall of the parking bay and wherein the tray enters the tray-receiving opening through a rear opening formed from the rear wall of the parking bay and sized to accommodate a width of a vehicle. In embodiments, the method may further comprise positioning a vehicle on an upper surface of the tray, wherein the vehicle enters the parking bay through a front opening formed from the front wall of the parking bay and sized to accommodate the width of the vehicle. In embodiments, the method may further comprise transporting, by the tray transportation mechanism, the tray from the tray-receiving opening and through the rear opening of the parking bay.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
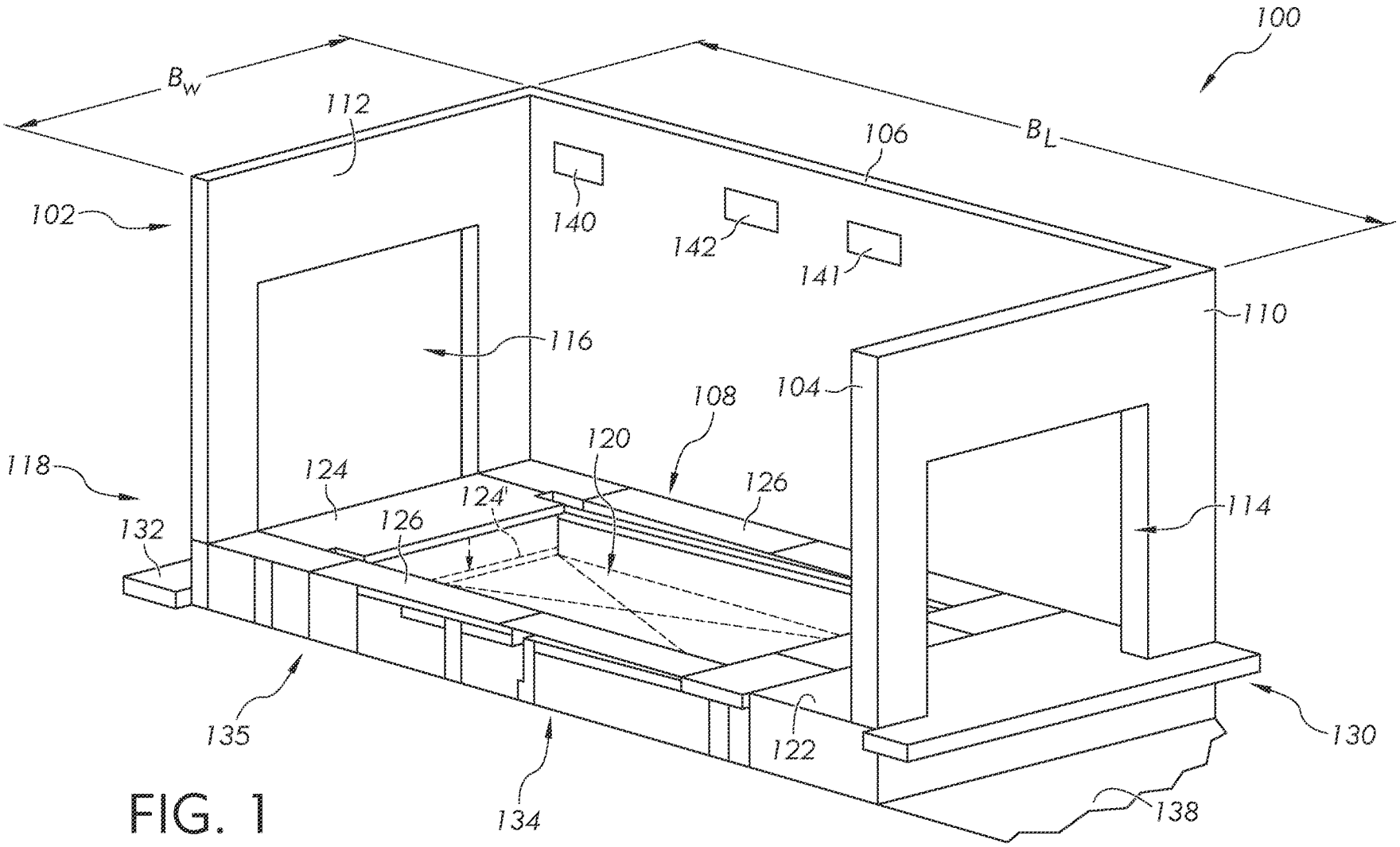
FIG. 1 schematically depicts a perspective view of an embodiment of a parking bay, according to one or more embodiments shown and described herein.

Embodiments described herein are directed to parking apparatuses, parking systems, and methods for parking a vehicle using the parking apparatuses and parking systems described herein. Embodiments of parking apparatuses and parking systems described herein generally include a parking bay including a sloped floor defining a tray-receiving opening and a tray positionable within the tray-receiving opening. In embodiments, the tray includes an upper surface configured to have a slope corresponding to a slope of the sloped floor when positioned within the tray-receiving opening. In embodiments, an automated guided vehicle ("AGV") may be configured to position or remove the tray from within the tray-receiving opening such as when a vehicle is parked upon the tray. In embodiments, the AGV may include a lifting mechanism operable between a lower position (e.g., in which the lifting mechanism does not engage the tray), an intermediate position (e.g., in which the lifting mechanism engages or mates with the tray), and a raised position (e.g., in which the lifting mechanism extends to raise the tray off of a floor surface on which the AGV travels). In embodiments, an AGV carrying the tray having a vehicle parked thereon may transport the tray and the vehicle between a parking space and the parking bay. Various embodiments of the apparatuses and systems and the operation of the apparatuses and systems are described in more detail herein. Whenever possible, the same reference numerals will be used throughout the drawings to refer to the same or like parts.

Figure 2:
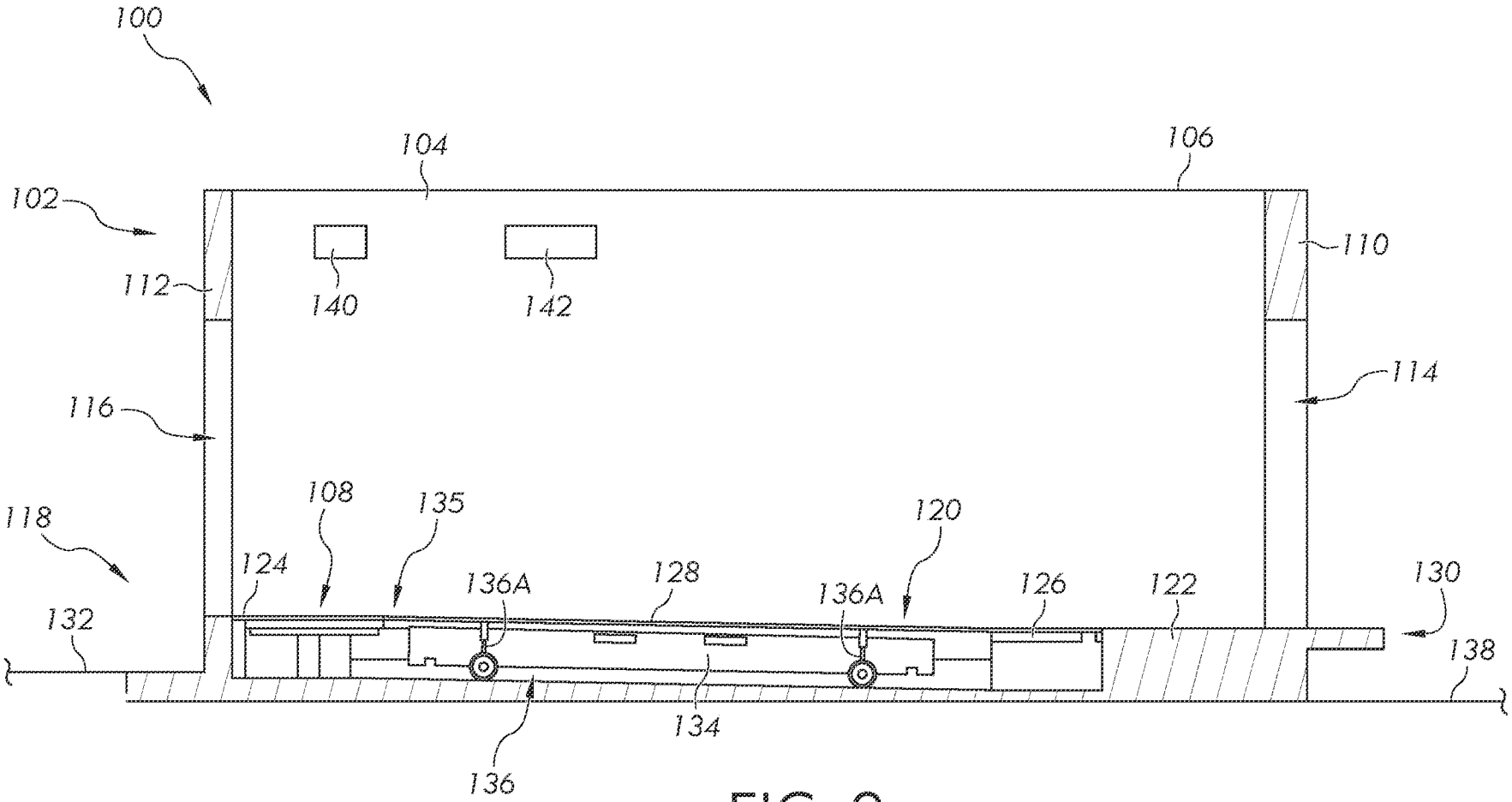
FIG. 2 schematically depicts a cross section view of the parking bay of FIG. 1, according to one or more embodiments shown and described herein.

Referring now to FIGS. 1 and 2, a parking bay 100 is illustrated according to one or more embodiments described herein. In embodiments, the parking bay 100 includes a plurality of walls defining an enclosure 102. Specifically, the parking bay 100 includes a pair of side walls 104, a top wall 106 extending between the side walls 104, and a sloped floor 108 opposite the top wall 106 and extending between the side walls 104. In embodiments, the parking bay 100 further includes a front wall 110 and a rear wall 112 opposite the front wall 110. The front wall 110 and the rear wall 112 each extend between the side walls 104 and the top wall 106, such that, in embodiments, the sloped floor 108 is provided between the front wall 110 and the rear wall 112. In embodiments, the sloped floor 108 may extend entirely between the front wall 110 and the rear wall 112. In embodiments, the sloped floor 108 may only extend from one of the front wall 110 or the rear wall 112 (and, in certain such embodiments, toward the rear wall 112 or toward the front wall 110, respectively). In embodiments, the sloped floor 108 may not extend from either of the front wall 110 or the rear wall 112, and may, instead, merely be positioned between the front wall 110 and the rear wall 112. In embodiments, the front wall 110 and the rear wall 112 may define a patron entrance 114 (e.g., a front opening of the parking bay 100) and a AGV entrance 116 (e.g., a rear opening of the parking bay 100), respectively, formed therein. The parking bay 100 has a parking bay width B w defined by a width of the front wall 110 and the rear wall 112 (e.g., a distance between the side walls 104). Additionally, the parking bay 100 has a parking bay length BL defined by a distance between the front wall 110 and the rear wall 112 (e.g., a length of the side walls 104). In other embodiments, the patron entrance 114 and the AGV entrance 116 may be defined by the side walls 104, the top wall 106, and the sloped floor 108 themselves such that the front wall 110 and the rear wall 112 are not present. Accordingly, in embodiments, the patron entrance 114 may be defined by the rear wall 112, the side walls 104, the sloped floor 108, or any combination thereof, and the AGV entrance 116 may be defined by the front wall 110, the side walls 104, the sloped floor 108, or any combination thereof.

Although not shown, in embodiments, the parking bay 100 may also include a forward-facing door provided at the patron entrance 114 of the parking bay 100 and a rearward-facing door provided at the AGV entrance 116 of the parking bay 100. In embodiments, the forward-facing door and the rearward-facing door are pivotally or slidably attached to the front wall 110 and the rear wall 112, respectively, so as to open and close about the patron entrance 114 and the AGV entrance 116. In other embodiments, the forward-facing door and the rearward-facing door are retractable doors extending into the front wall 110 and the rear wall 112, respectively, and/or the side walls 104 in embodiments in which the front wall 110 and the rear wall 112 may not be provided. In other embodiments, the forward-facing door and the rearward-facing door may be formed in adjacent walls of the parking bay 100 rather than opposite walls.

As described in more detail herein, it should be understood that a vehicle to be parked within a parking garage 118 may enter the parking bay 100 through the patron entrance 114 formed in the front wall 110 and may be moved to a target parking space within the parking garage 118 by being transported out of the parking bay 100 through the AGV entrance 116 formed in the rear wall 112, such as by an AGV. Accordingly, in embodiments, the patron entrance 114 may be sized to accommodate a width of a vehicle, and, in embodiments, the AGV entrance 116 may be sized to accommodate a width of an AGV or any other suitable tray transportation mechanism. In other embodiments, the vehicle to be parked within the parking garage 118 may enter the parking bay 100 through the patron entrance 114 formed in the front wall 110 and may be moved to a target parking space within the parking garage 118 by being transported through the AGV entrance 116, which may be formed in one of the side walls 104 rather than the rear wall 112. In other embodiments, the vehicle to be parked may be moved to a target parking space by being lowered through the sloped floor 108 of the parking bay 100. This embodiment is representative of an elevator configuration that moves the vehicle to a parking space located on a floor of the parking garage 118 other than the floor in which the parking bay 100 itself is located.

In embodiments, a tray-receiving opening 120 is formed in the sloped floor 108 in which a tray is received, as described in more detail herein. Accordingly, in embodiments, the tray-receiving opening 120 may be sized to contain a tray (e.g., a tray 128, as depicted in FIG. 2 and described herein below). In addition, in embodiments, the sloped floor 108 may include a plurality of floor segments, which cooperate to define the tray-receiving opening 120 formed in the sloped floor 108. In embodiments, the sloped floor 108 includes an entrance platform 122 provided between the tray-receiving opening 120 and the front wall 110 of the parking bay 100, an overdrive platform 124 provided between the tray-receiving opening 120 and the rear wall 112 of the parking bay 100, and a pair of transition pieces 126 extending between the tray-receiving opening 120 and opposite side walls 104 of the parking bay 100. In embodiments (such as, for example, embodiments wherein the sloped floor 108 is positioned between but not extending from the front wall 110 and the rear wall 112), the entrance platform 122 may be substantially horizontal (e.g., not having a slope). In embodiments (such as, for example, embodiments wherein the sloped floor 108 is positioned between but not extending from the front wall 110 and the rear wall 112), the overdrive platform 124 may be substantially horizontal (e.g., not having a slope). In embodiments, the entrance platform 122 may have a slope substantially corresponding to a slope of the sloped floor 108. In embodiments, the overdrive platform 124 may have a slope substantially corresponding to a slope of the sloped floor 108. In embodiments, the entrance platform 122 and the overdrive platform 124 may have a slope substantially corresponding to a slope of the sloped floor 108. In embodiments, neither the entrance platform 122 nor the overdrive platform 124 have a slope substantially corresponding to a slope of the sloped floor 108.

As described herein, a tray 128, as shown in FIG. 2, may be positioned within the tray-receiving opening 120 and a vehicle to be parked may be positioned on the tray 128. Accordingly, in embodiments, the tray 128 is sized to accommodate a vehicle (e.g., the vehicle 144, as described below and depicted in FIG. 4). To eliminate or reduce any gaps formed between the tray 128 and the sloped floor 108 such as, for example, the overdrive platform 124, the entrance platform 122, and the transition pieces 126, one or more gap-eliminating pieces may be provided. For example, in embodiments, the gap-eliminating pieces of the sloped floor 108 include one or more stationary or movable guides, spacers, bridges, plates, platforms, mechanical devices, either actively or passively actuated, and the like, or a combination thereof, that extend between the sloped floor 108 and the tray 128, when positioned within the tray-receiving opening 120, to reduce any gaps formed therebetween.

As described herein, the sloped floor 108 of the parking bay 100 is at least partially oriented to be at an incline between the patron entrance 114 and the AGV entrance 116. In embodiments, the sloped floor 108 of the parking bay 100 may be inclined in a downward direction from the AGV entrance 116 toward the patron entrance 114. In other embodiments, the sloped floor 108 of the parking bay 100 may be inclined in an upward direction from the AGV entrance 116 toward the patron entrance 114. In the embodiment of FIG. 2, a ground level 138, on which the parking bay 100 is provided, is oriented (at least, in embodiments, between the front wall 110 and the rear wall 112) at an incline, such that, for example, an AGV 136 carrying the tray 128 is inclined such that the tray 128 may have a slope substantially corresponding to a slope of the sloped floor 108. In other embodiments, the sloped floor 108 may be oriented at an incline relative to the ground level 138, such that the ground level 138 is, for example, substantially horizontal or otherwise defining an angle relative to the sloped floor 108 (at least, in embodiments, between the front wall 110 and the rear wall 112). In embodiments, an AGV 136 carrying the tray 128 may include a lifting mechanism (as is described in further detail below with reference to FIG. 4) comprising lifting members 136A which, in embodiments may support the tray 128 atop the AGV 136. In certain such embodiments, the lifting members 136A may be independently extendable within a range of heights such that the lifting members 136A may, in embodiments, orient the tray 128 at a slope substantially corresponding to a slope of the sloped floor 108. In embodiments, the lifting mechanism may include one lifting member 136A, two lifting members 136A, three lifting members 136A, four lifting members 136A, or even five or more lifting members 136A. In embodiments, the lifting members 136A may be, for example, telescoping extension rods which may be extended or retracted (e.g., to support, orient, or otherwise adjust a height of part or all of the tray 128) by, e.g., a motor of the lifting mechanism and/or the AGV 136.

In embodiments, only portions of the sloped floor 108 of the parking bay 100 are oriented at an incline while other portions of the sloped floor 108 remain horizontal relative to the ground level 138. For example, the overdrive platform 124 and the entrance platform 122 may be positioned to be parallel to one another and horizontal relative to (e.g., planar with or parallel to) a driveway 130 provided exterior of the parking bay 100 proximate the patron entrance 114 of the parking bay 100. Accordingly, the transition pieces 126 may be positioned to extend at an incline from the entrance platform 122 to the overdrive platform 124. In embodiments, the entrance platform 122 may be positioned vertically lower than the overdrive platform 124 such that the transition pieces 126 extend in an upward direction from the entrance platform 122 to the overdrive platform 124. In other embodiments, the entrance platform 122 may be positioned vertically higher than the overdrive platform 124 such that the transition pieces 126 extend in a downward direction from the entrance platform 122 to the overdrive platform 124.

Figure 4:
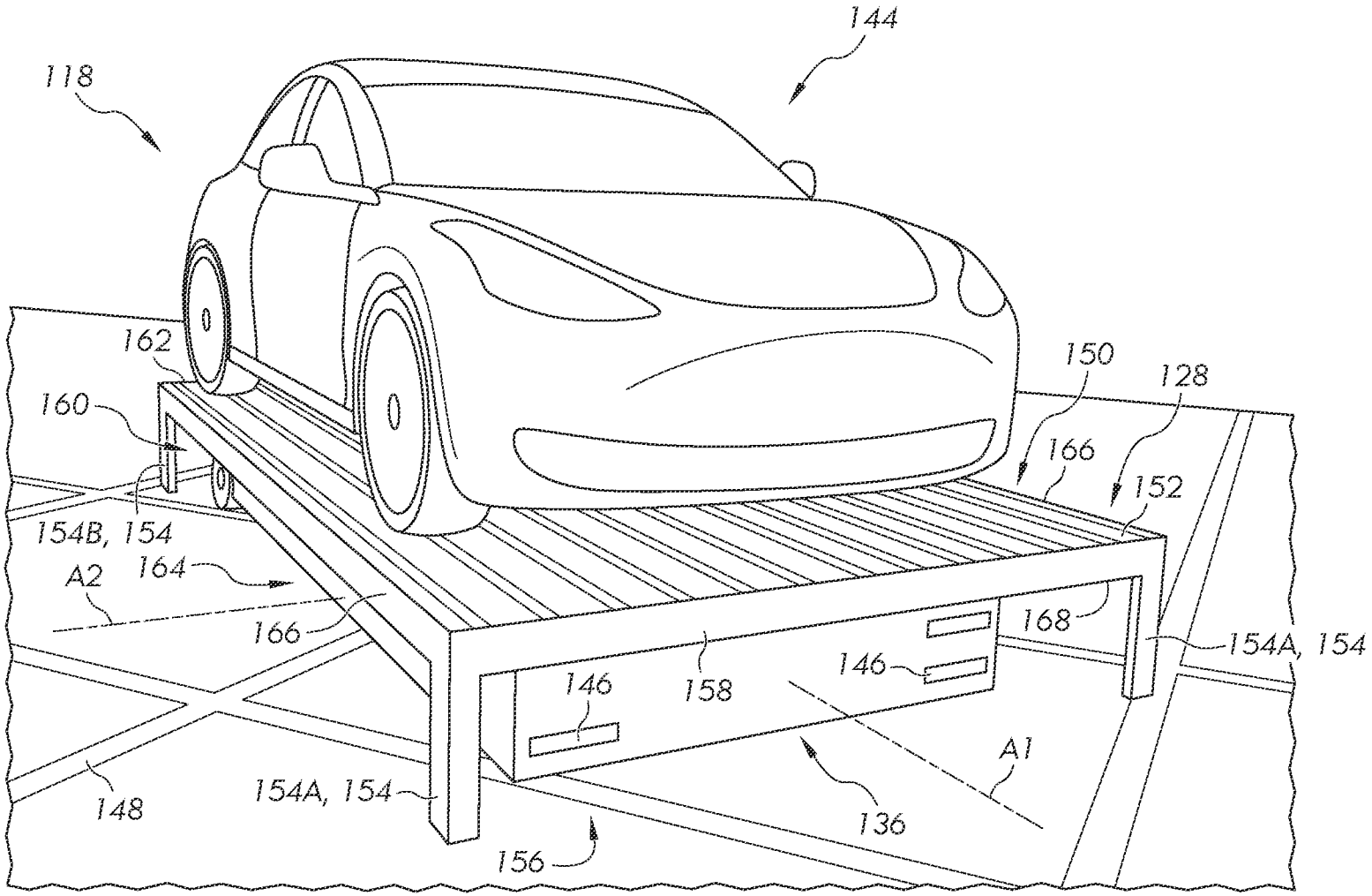
FIG. 4 schematically depicts a perspective view of an automated guided vehicle carrying a vehicle on a tray, according to one or more embodiments shown and described herein.

As described in more detail herein, a tray 128 may be positioned within the parking bay 100 through the AGV entrance 116 and received within the tray-receiving opening 120 such that a vehicle to be parked may be positioned on the tray 128 and subsequently moved back through the AGV entrance 116 and to a target parking space within the parking garage 118, such as by operation of the AGV 136 carrying the tray 128. Accordingly, the overdrive platform 124 must be moved out of the moving path of the tray 128 and the AGV when the tray 128 is being moved through the AGV entrance 116 of the parking bay 100. Therefore, the overdrive platform 124 is positionable between a use position, as shown in FIGS. 1 and 2, in which the overdrive platform 124 is positioned in line with the rest of the sloped floor 108, and a retracted position in which the overdrive platform 124 is moved such that the AGV entrance 116 is exposed. Accordingly, in embodiments, when the overdrive platform 124 is in the retracted position, the overdrive platform 124 is moved out of the moving path of the tray 128 and a tray transportation mechanism (e.g., an AGV 136, as depicted in FIG. 4 and described in further detail below) such that the AGV entrance 116 is exposed.

In embodiments, the overdrive platform 124 is moved in a vertical direction away from the top wall 106 of the parking bay 100 and into a retracted position 124' so that the AGV entrance 116 is exposed such that the overdrive platform 124 does not interfere with the tray 128 and the tray transportation mechanism carrying the tray 128 through the AGV entrance 116. In other embodiments, the overdrive platform 124 pivots toward one or both of the side walls 104 of the parking bay 100 to be in the retracted position. Further, in embodiments in which the overdrive platform 124 is configured to pivot, the overdrive platform 124 may be separable into a pair of overdrive platform segments such that each overdrive platform segment pivots toward a respective side wall 104 of the parking bay 100 and into the retracted position. For example, one of the overdrive platform segments pivots upward toward one of the side walls 104 of the parking bay 100 and the other overdrive platform segment pivots upward toward the other of the side walls 104 of the parking bay 100 in opposite directions. Once the tray 128 is positioned within the tray-receiving opening 120 formed in the sloped floor 108 of the parking bay 100, the overdrive platform 124 may be returned to the use position.

Referring still to FIGS. 1 and 2, the sloped floor 108 of the parking bay 100 is elevated relative to a floor surface 132 of the parking garage 118 located proximate the AGV entrance 116 of the parking bay 100. As shown in FIG. 2, the AGV entrance 116 extends to the floor surface 132 of the parking garage 118 and an AGV area 134 is provided under the sloped floor 108. As shown in FIG. 2, an AGV 136 is permitted to enter the parking bay 100 through the AGV entrance 116 and be positioned within the AGV area 134 below the sloped floor 108. As described in more detail herein, once the AGV 136 is positioned below the sloped floor 108, the AGV 136 may be configured to position or remove the tray 128 from within the tray-receiving opening 120 formed in the sloped floor 108 of the parking bay 100.

Figure 3A:
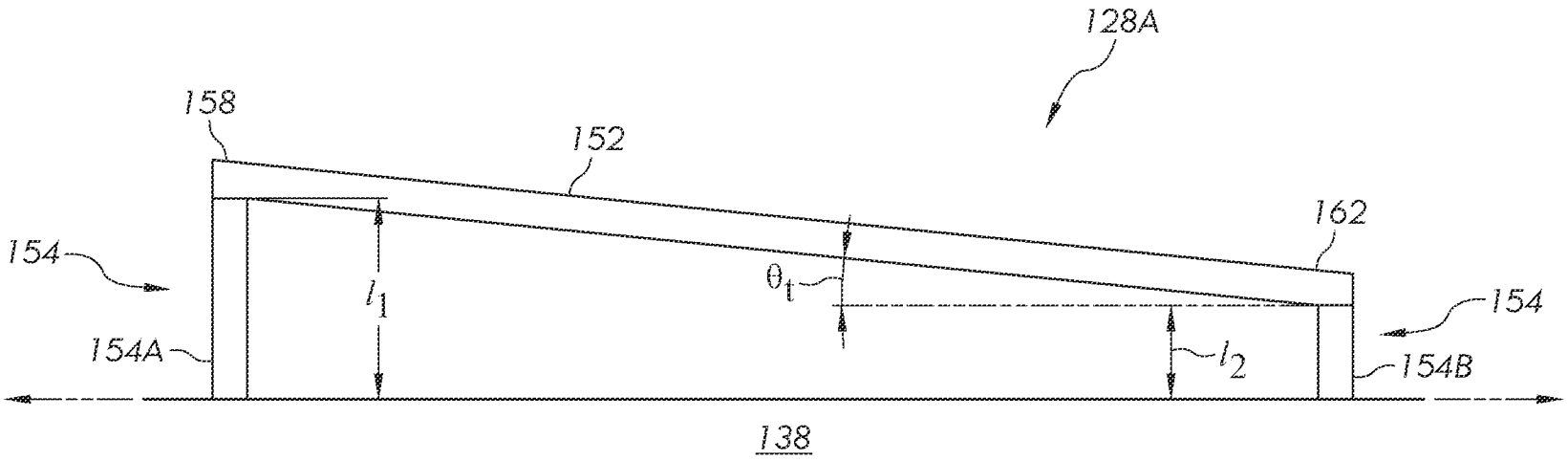
FIG. 3A schematically depicts a side view of a tray including a pair of front legs longer than a pair of rear legs of the tray, according to one or more embodiments shown and described herein.
Figure 3B:
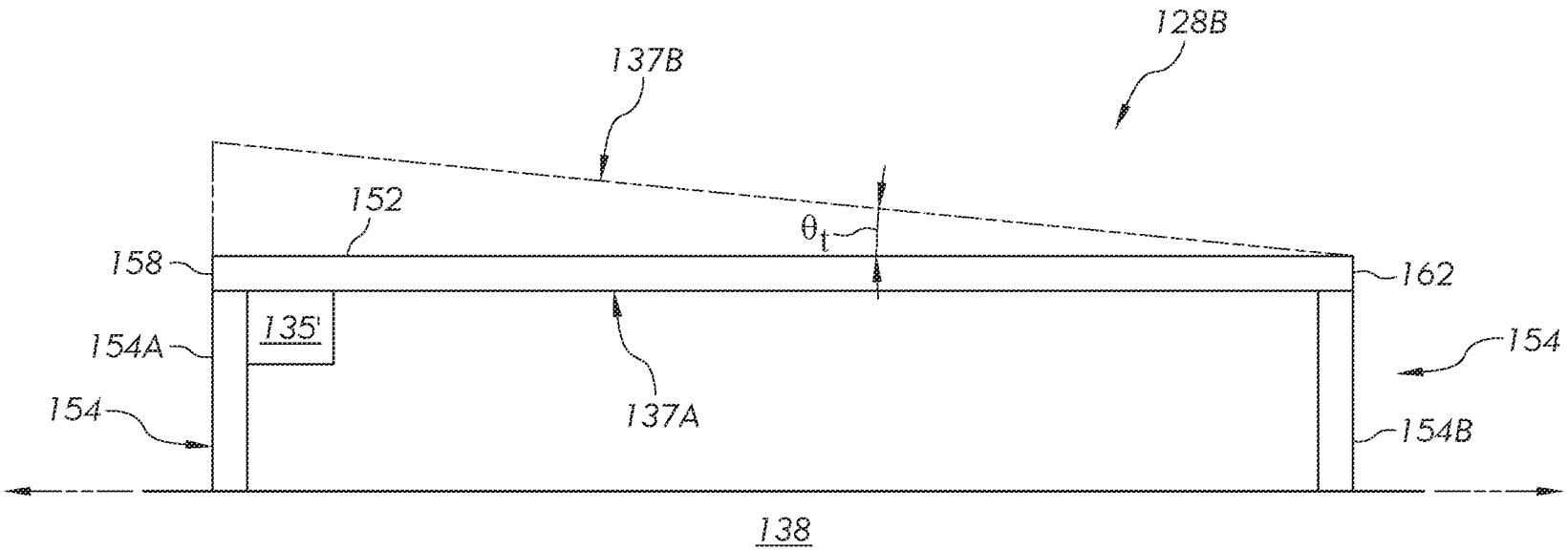
FIG. 3B schematically depicts a side view of a tray including a drive mechanism, according to one or more embodiments shown and described herein.

It should be appreciated that, in embodiments, when the tray 128 is positioned within the tray-receiving opening 120 formed in the sloped floor 108 of the parking bay 100, a slope of the tray 128 corresponds to (e.g., matches) the slope of at least the transition pieces 126 of the sloped floor 108. As used herein, a slope of the tray 128 corresponding to a slope of the sloped floor 108 refers to an upper surface 152 (as depicted in FIGS. 3A-B and 4, and as described in further detail below) of the tray 128 and the sloped floor 108 having a continuous slope or substantially continuous slope without any substantial gaps or substantial changes in elevation provided at abutting edges of the upper surface 152 of the tray 128 and the sloped floor 108. In embodiments, the slope of the sloped floor 108 may differ from the slope of the tray 128 by less than or equal to 10 degrees. In embodiments, a difference between the slope of the sloped floor 108 and the slope of the tray 128 is 10 degrees +/−10%. In embodiments, a difference between the slope of the sloped floor 108 and the slope of the tray 128 is 10 degrees +/−20%. In embodiments, a difference between the slope of the sloped floor 108 and the slope of the tray 128 is 10 degrees +/−30%. In embodiments, a difference between the slope of the sloped floor 108 and the slope of the tray 128 is 10 degrees +/−40%. In embodiments, a difference between the slope of the sloped floor 108 and the slope of the tray 128 is 10 degrees +/−50%. Accordingly, this provides for a smooth transition for a vehicle driving, for example, from the entrance platform 122, onto the tray 128, and onto the overdrive platform 124 if the vehicle drives too far forward into the parking bay 100. In instances in which the slope of the tray 128 does not correspond to the slope of the sloped floor 108, a vehicle may become stuck or the operator of the vehicle may exhibit a bumpy transition across the various surfaces in the parking bay 100.

Referring to FIG. 3A, in embodiments, an upper surface 152 of an angled tray 128A has a fixed slope, as defined by the angle $\theta_t$. It should be appreciated that the angled tray 128A is similar to the tray 128 and, therefore, like parts will be described with like reference characters. In embodiments, the fixed slope of the upper surface 152 may correspond to the slope of the sloped floor 108, and, more particularly, the transition pieces 126. As such, in such embodiments, when the angled tray 128A is positioned within the tray-receiving opening 120 of the sloped floor 108, no further adjustments to the angled tray 128A and/or the sloped floor 108 are necessary to align the angled tray 128A with the sloped floor 108. In embodiments, the fixed slope of the upper surface 152 may be defined by a plurality of legs 154 of the angled tray 128A. In embodiments, a pair of front legs 154A of the plurality of legs 154 define a first length ($l_1$), while a pair of rear legs 154B of the plurality of legs 154 define a second length ($l_2$), wherein the first length ($l_1$) is longer than the second length ($l_2$). Accordingly, in such embodiments, the pair of front legs 154A position a front end 158 of the angled tray 128A at a height greater than a height of a rear end 162 of the angled tray 128A positioned by the pair of rear legs 154B. However, in other embodiments, the second length ($l_2$) may be longer than the first length ($l_1$), such that the pair of rear legs 154B position the rear end 162 at a height greater than a height of the front end 158 positioned by the pair of front legs 154A.

Referring to FIG. 3B, in other embodiments, another embodiment of an adjustable tray 128B is described herein. It should be appreciated that the adjustable tray 128B is similar to the tray 128 and, therefore, like parts will be described with like reference characters. The adjustable tray 128B includes a drive mechanism 135' for orienting the upper surface 152, such that the front end 158 is movable, vertically, relative to the rear end 162. The drive mechanism 135' may be controlled to adjust a slope of the upper surface 152 between a level position 137A and a sloped position 137B such that, in the level position 137A (as depicted in FIG. 3B by solid lines), the upper surface 152 is substantially parallel to the ground level 138, and, in the sloped position 137B (as depicted in FIG. 3B by dashed lines), the upper surface 152 has a slope as defined by the angle $\theta_t$, corresponding to a slope of the transition pieces 126 (FIG. 1) and extending, when in the tray-receiving opening 120, from the entrance platform 122 to the overdrive platform 124 (FIG. 1). In this embodiment, once it is determined, by one or more sensors positioned on the tray 128B and/or within the parking bay 100 (e.g., sensors 140 of the parking bay 100, as depicted in FIGS. 1-2 and described in further detail below, and/or navigation sensors 146 of the tray 128B, as depicted in FIG. 4 and described in further detail below), that the tray 128B is positioned within the tray-receiving opening 120 of the parking bay 100, the drive mechanism 135' may be operated to raise, lower, and/or tilt the upper surface 152 of the tray 128B (e.g., between the level position 137A and the sloped position 137B) such that the slope of the upper surface 152 corresponds to the slope of the transition pieces 126 and extends from the entrance platform 122 to the overdrive platform 124. In embodiments, the drive mechanism 135' may be, for example, a motor which extends the pair of front legs 154A (e.g., by the pair of front legs 154A being telescoping and having an adjustable length) to provide the upper surface 152 with a slope. While, in the embodiment depicted in FIG. 3B, the drive mechanism 135' is depicted as increasing a length of the pair of front legs 154A, in other embodiments, the drive mechanism 135' may be capable of increasing the length of any, some, or all of the plurality of legs 154, including, in embodiments, only the pair of rear legs 154B or both the pair of front legs 154A and the pair of rear legs 154B at different rates.

Figure 3C:
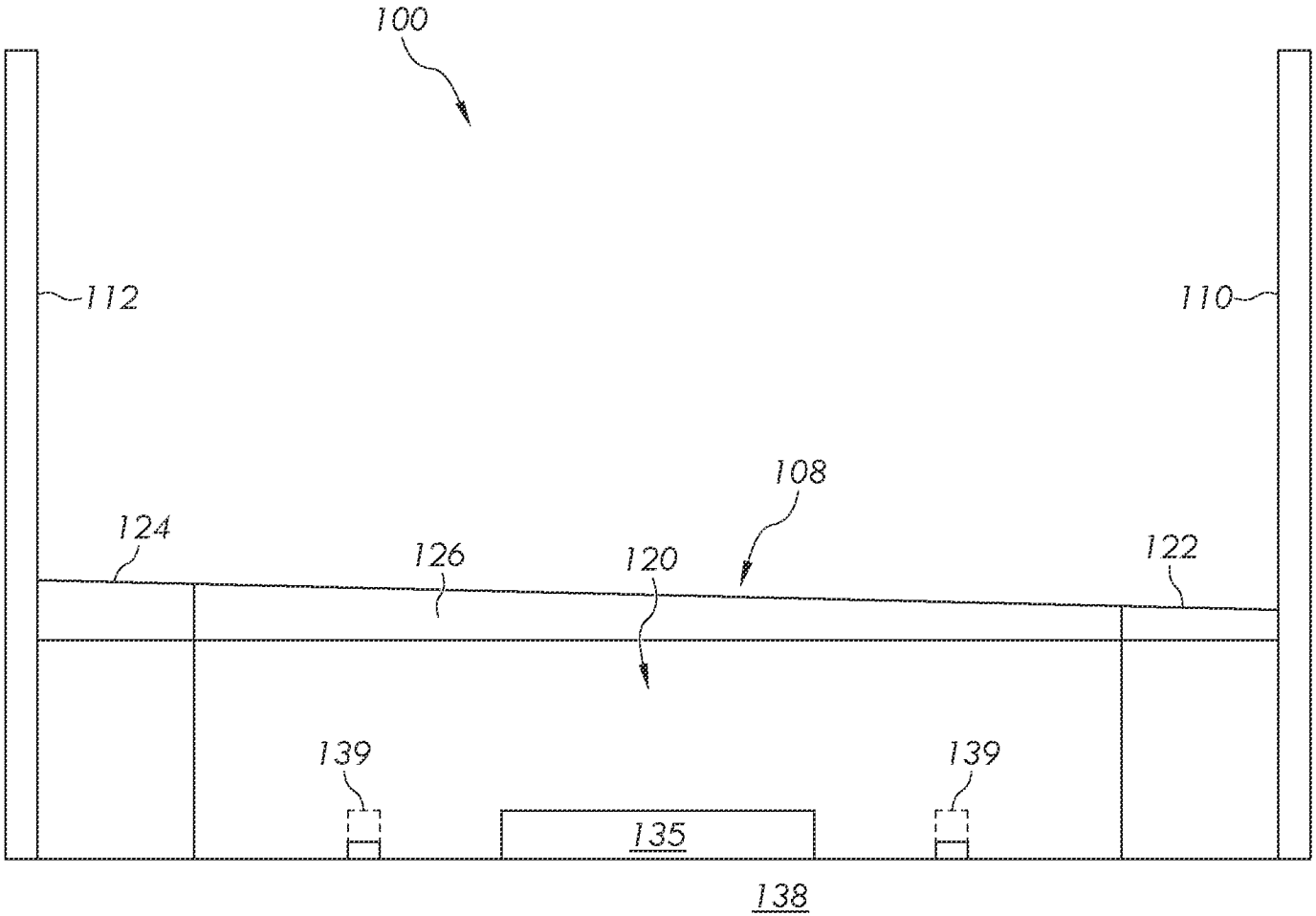
FIG. 3C schematically depicts a cross-sectional view of another embodiment of the parking bay including a drive mechanism and extension pieces extending from a ground level, according to one or more embodiments shown and described herein.

Referring to FIG. 3C, in other embodiments, the parking bay 100 includes the drive mechanism 135 and one or more extension pieces 139 electronically coupled to the drive mechanism 135 for engaging a portion of the tray 128 (FIG. 1) when positioned within the tray-receiving opening 120 and adjusting a slope of the tray 128 to correspond to a slope of the transition pieces 126 and extend from the entrance platform 122 to the overdrive platform 124. For example, the one or more extension pieces 139 may be, in embodiments, configured to extend and retract from the ground level 138, such that the extension pieces 139 engage, in embodiments, any, some, or all of the plurality of legs 154 and/or a bottom side of the upper surface 152 of the tray 128 (FIG. 1). Specifically, the extension pieces 139 may extend from the ground level 138 from a first height (e.g., as depicted in FIG. 3C by solid lines) to a second height (e.g., as depicted in FIG. 3C by dashed lines) to raise or lower either or both of the front end 158 or the rear end 162 of the tray 128 (FIG. 1). In embodiments, the sloped floor 108 may include only one extension piece 139 (e.g., configured to engage with a bottom of the upper surface 152 of the tray 128). In embodiments, the sloped floor 108 may include only two extension pieces 139 (e.g., configured to engage with either the pair of front legs 154A or the pair of rear legs 154B of the tray 128). In embodiments, the sloped floor 108 may include four extension pieces 139 (e.g., configured to engage with each of the plurality of legs 154). In embodiments, the drive mechanism 135 may be, for example, a motor which raises or lowers the extension pieces 139. In embodiments, the sloped floor 108 may include the extension pieces 139, but not the drive mechanism 135, such that the extension pieces 139 have fixed heights. In such embodiments, for example, when the tray 128 is positioned within the tray-receiving opening 120, any, some, or all of the legs 154 and/or a bottom side of the upper surface 152 may rest upon the extension pieces 139, providing the tray 128 with a slope corresponding to a slope of the transition pieces 126, as provided by a height of the extension pieces 139.

Figure 3D:
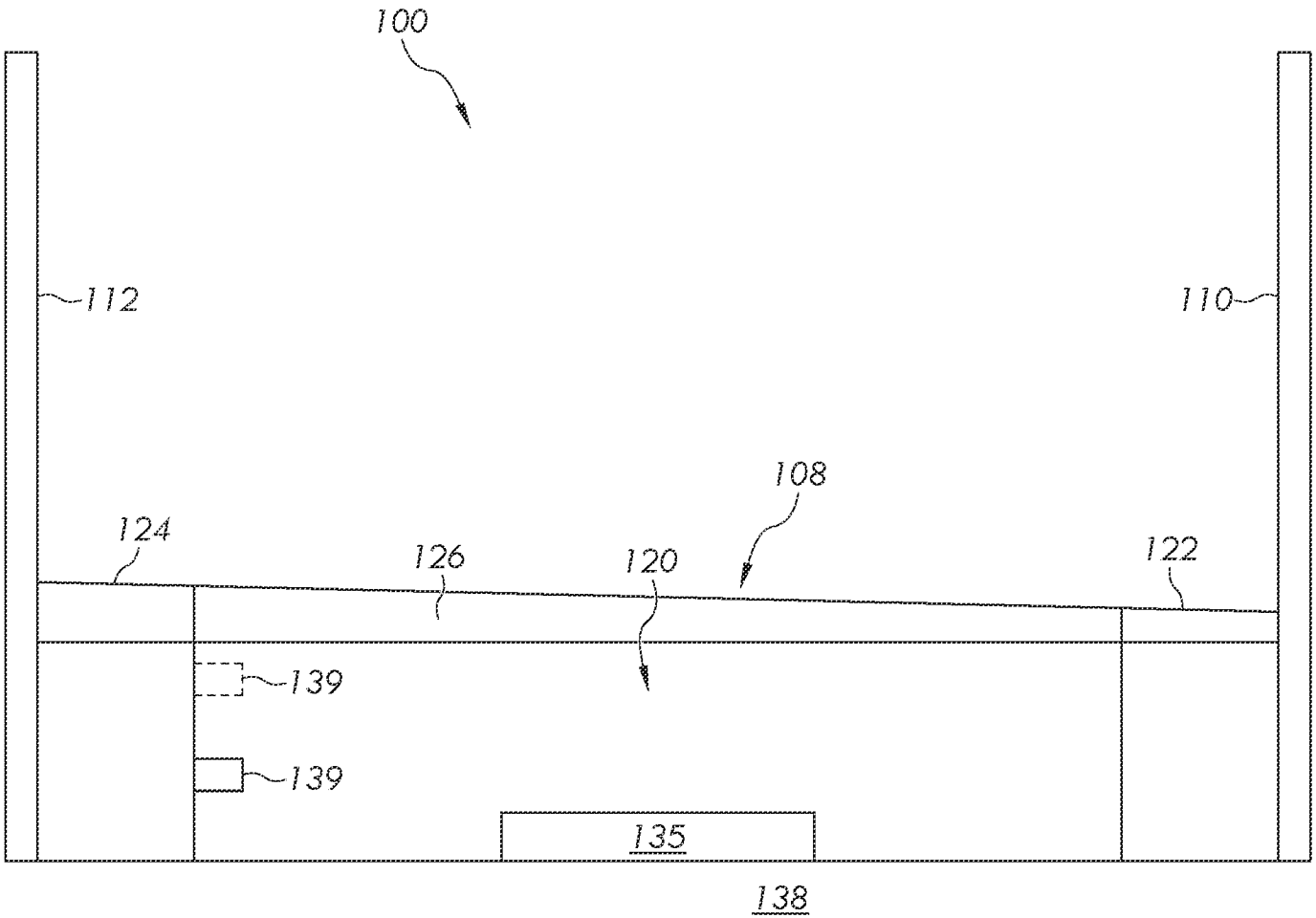
FIG. 3D schematically depicts a cross-sectional view of another embodiment of the parking bay having a drive mechanism and extension pieces extending from an over-drive platform, according to one or more embodiments shown and described herein.

Referring to FIG. 3D, in other embodiments, the sloped floor 108 may again include the drive mechanism 135 and one or more extension pieces 139. However, contrary to the embodiment of FIG. 3C, in the embodiment of FIG. 3D, the extension pieces 139 extend from the overdrive platform 124 to engage an end of the tray 128 proximate the overdrive platform 124. Although only one extension piece 139 is depicted, it should be appreciated that a plurality of extension pieces 139 may be provided and spaced apart from one another in a lateral direction along the overdrive platform 124. In this embodiment, the extension pieces 139 may move in a vertical direction from a first position (as depicted in FIG. 3D by solid lines) toward the top wall 106 to a second position (as depicted in FIG. 3D by dashed lines) to lift the front end 158 of the tray 128 relative to the rear end 162 of the tray 128 (FIG. 3A) positioned proximate the patron entrance 114 of the parking bay 100. However, in other embodiments, the extension pieces 139 may instead extend from the entrance platform 122 and raise or lower the rear end 162 relative to the front end 158 of the tray 128 (FIG. 3A). While, in the embodiment of FIG. 3D, the extension pieces 139 are electronically coupled to the drive mechanism 135, in other embodiments, the sloped floor 108 may include the extension pieces 139, but not the drive mechanism 135. In such embodiments, the extension pieces 139 may be, for example, pins that are fixed in place (e.g., at the position depicted in FIG. 3D by dashed lines), wherein the tray 128, while being positioned in the tray-receiving opening 120, is lowered such that the pair of rear legs 154B contact the ground level 138 while the front end 158 of the tray 128 rests upon the extension pieces 139.

It should be appreciated that other drive mechanisms 135 and methods of adjusting a slope of the tray 128 to correspond to a slope of the sloped floor 108, e.g., the transition pieces 126, not described herein are contemplated and within the scope of the present disclosure. For example, the sloped floor 108 and/or the tray 128 may include a drive mechanism 135 including one or more movable ramps, pins, clamps, plates, platforms, mechanical conveyors, either actively or passively actuated, and the like, or a combination thereof, to orient the tray 128 to provide a slope corresponding to that of the sloped floor 108.

Returning to FIGS. 1-3B, in embodiments, the upper surface 152 of the tray 128, as well as the transition pieces 126, may be oriented to be at an angle greater than or equal to 0.5 degrees and less than or equal to 10 degrees relative to the ground level 138 on which the parking bay 100 is situated. In embodiments, the upper surface 152 of the tray 128, as well as the transition pieces 126, may be oriented to be at an angle between 1 degrees and 2 degrees relative to the ground level 138.

In embodiments, the parking bay 100 may include one or more sensors 140 such as, for example, electronic sensors, vision systems (e.g., an object-detection sensor or a camera), mirrors, identified boundaries, and the like or a combination thereof, for detecting a position of a vehicle within the parking bay 100, the presence of a tray 128 within the tray-receiving opening 120, an orientation of the tray 128, and the like.

In embodiments, the parking bay 100 may include a control system 141 (e.g., a computing device) configured to instruct the AGV 136, the sloped floor 108, and/or any components of the sloped floor 108 (including, in embodiments, any, some, or all of the entrance platform 122, the overdrive platform 124, the transition pieces 126, the drive mechanism 135, and/or the extension pieces 139) to move or operate, e.g., in response to determining (e.g., via the sensors 140) that a vehicle is approaching the parking bay 100 (e.g., indicating a desire to be parked within the parking garage 118).

In embodiments, the parking bay 100 further includes one or more indicators 142 providing instruction to an operator of a vehicle entering the parking bay 100. For example, the indicator 142 may be a sign displaying instruction to the operator such as, for example, to drive forward, to place the vehicle into park, and the like. The indicators 142 may provide feedback to the operator to assist in properly positioning the vehicle properly on the tray 128. In embodiments, the indicators 142 may include visual and/or audible notification devices such as, for example, display screens, minors, projections, speakers, identified boundaries, and the like, or a combination thereof.

Although it is described herein that an AGV 136 may be configured to move a vehicle to and from the parking bay 100, it should be appreciated that other tray transportation mechanisms for transporting a vehicle to and from the parking bay 100 are contemplated as being within the scope of the present disclosure. For example, one or more movable plates, doors, platforms, mechanical conveyors, either actively or passively actuated, other pallet moving equipment, and the like, or a combination thereof, may be provided as tray transportation mechanisms to move the tray 128 into the tray-receiving opening 120 formed in the sloped floor 108 and/or transport the vehicle directly without a separate tray 128. In certain such embodiments, the tray 128 may lack legs (such as a plurality of legs 154, as depicted in FIG. 4 and described in further detail below), and may rather, in embodiments, rest upon the tray transportation mechanism.

Referring now to FIG. 4, an embodiment of the AGV 136 is illustrated carrying a tray 128 on which a vehicle 144 is supported. In embodiments, the AGV 136 is an omnidirectional vehicle including omnidirectional wheels such as, for example, Mecanum wheels. As used herein, "omnidirectional vehicle" refers to any vehicle capable of moving in directions other than just a forward vehicle longitudinal direction and a rearward vehicle longitudinal direction. Specifically, the AGV 136 is capable of rotating about a central point of the AGV 136, moving in a sideways vehicle lateral direction, and moving in a diagonal direction by independently controlling the direction of rotation of the omnidirectional wheels of the AGV 136. However, it should be appreciated that the AGV 136 may be any other suitable vehicle and not limited to being an omnidirectional vehicle including omnidirectional wheels.

The AGV 136 includes one or more navigation sensors 146 configured facilitate guidance with the system, and may include one or more sensors configured to detect an object or obstacle (e.g., a vision sensor), with either or both to assist the AGV 136 in performing an autonomous driving command. As shown in FIG. 4, the AGV 136 traverses the floor surface 132 of the parking garage 118 which is provided with indicia 148 or any other suitable marking identifiable by the navigation sensor 146 of the AGV 136 so that the AGV 136 may orient itself within the parking garage 118. As shown, the indicia 148 defines a grid on the floor surface 132 of the parking garage 118 identifying individual parking spaces in which trays 128 may be parked and also defines one or more paths on the floor surface 132 between parking spaces (e.g., by substantially parallel lines or curves defining a lane within which the AGV 136 may travel) for the AGV 136 to follow when moving between a parking bay 100 (as depicted in, e.g., FIG. 1) and a target parking space though other embodiments could use guidance or orientation methods.

As shown in FIG. 4, the tray 128 includes a tray platform 150 having an upper surface 152 on which the vehicle 144 is initially parked, and the plurality of legs 154 extending from corners of the tray platform 150. The legs 154 of the tray 128 support the tray 128 on the floor surface 132 and define gaps through which the AGV 136 moves so as to be positioned under the tray platform 150 of the tray 128. Specifically, the tray 128 may include the pair of front legs 154A defining a front gap 156 at the front end 158 of the tray 128 so the AGV 136 may be positioned below the tray 128 through the front end 158 of the tray 128 along a first axis Al, and the pair of rear legs 154B defining a rear gap 160 at the rear end 162 of the tray 128 so the AGV 136 may be positioned below the tray 128 through the rear end 162 of the tray 128 along the first axis A1. The pair of front legs 154A and the pair of rear legs 154B also define a pair of side gaps 164 at opposite sides 166 of the tray 128 so the AGV 136 may be positioned below the tray 128 through the sides 166 of the tray 128 along a second axis A2 transverse to the first axis Al. As such, in embodiments, the AGV 136 is dimensioned to be less than the front gap 156, the rear gap 160, and the side gaps 164.

The AGV 136 includes a lifting mechanism (as depicted in FIG. 2 as being formed from lifting members 136A and as described above) operable between a lowered position, in which the lifting mechanism does not engage the tray 128, an intermediate position in which the lifting mechanism engages or mates with the tray 128, and a raised position in which the lifting mechanism extends to raise the tray 128 off the floor surface 132 of the parking garage 118. Specifically, when the lifting mechanism is in the raised position, the lifting mechanism may engage a lower surface 168 of the tray platform 150 and is extended to lift the tray 128 off of the floor surface 132 of the parking garage 118. In embodiments, the AGV 136 may include one or more tray sensors, such as the navigation sensors 146 or a separate sensor, for example, a proximity sensor, to detect when the AGV 136 is positioned below the tray 128 and, in response to determining that the lifting mechanism is positioned below the tray 128, activate the lifting mechanism to move from the lowered position to the raised position to raise the tray 128. Additionally, when the lifting mechanism is in the raised position and carrying the tray 128, the navigation sensor 146 of the AGV 136 may be utilized to determine that the AGV 136 is in a target location for the tray 128 to be positioned such as, for example, a target parking space or a parking bay 100, and, in response, activate the lifting mechanism to move from the raised position to the lowered position to lower the tray 128 onto the floor surface 132 of the parking garage 118. However, it should be appreciated that the AGV 136 may be configured to engage and move a vehicle itself without use of a tray 128.

Figure 5:
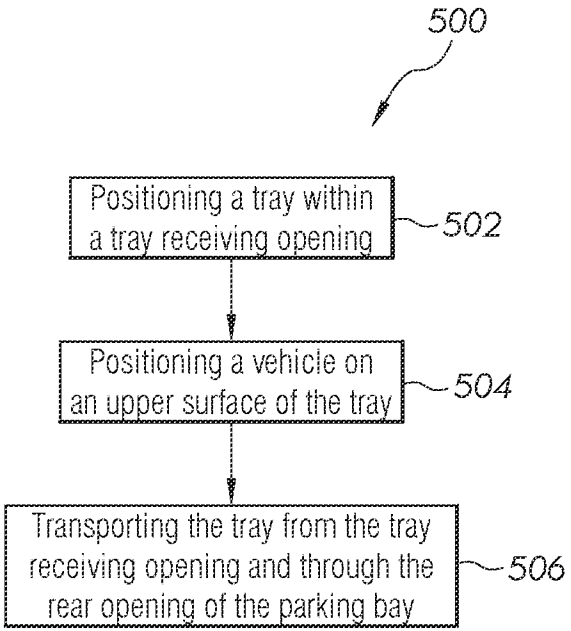
FIG. 5 is a flow diagram of a method for orienting a tray at a slope within a parking bay, according to one or more embodiments shown and described herein.

Referring now to FIG. 5 and with reference to FIGS. 1-2 and 4, a flow diagram 500 depicts a method of orienting a tray within a parking bay on a slope.

At block 502, the tray 128 is positioned, by a tray transportation mechanism (e.g., the AGV 136) within the tray-receiving opening 120 defined by the sloped floor 108 of the parking bay 100 and sized to contain the tray 128. Specifically, the tray 128 enters the tray-receiving opening 120 through the AGV entrance 116 defined by the rear wall 112 of the parking bay 100, the side walls 104 of the parking bay 100, or any combination thereof. In embodiments, a tray 128 may initially not be present within the tray-receiving opening 120 formed in the sloped floor 108 and the overdrive platform 124 may be in the use position. Accordingly, in embodiments, in response to receiving instruction from the control system 141 that a vehicle (e.g., the vehicle 144) desires to be parked within the parking garage 118, the overdrive platform 124 is operated to move into the retracted position to permit a tray transportation mechanism (e.g., the AGV 136) to position a tray 128 within the parking bay 100. Accordingly, in embodiments, the AGV 136 carrying the tray 128, as shown in FIG. 4, enters the parking bay 100 through the AGV entrance 116 and positions the tray 128 within the tray-receiving opening 120 formed in the sloped floor 108. Thereafter, in embodiments, in response to the tray 128 being detected by the one or more sensors 140, the drive mechanism 135 orients the tray 128 to be sloped and corresponding to a slope of the transition pieces 126 in the manner discussed herein.

At block 504, a vehicle (e.g., the vehicle 144) is positioned on the upper surface 152 of the tray 128, wherein the vehicle enters the parking bay 100 through the patron entrance 114 defined by the front wall 110 of the parking bay 100, the side walls 104 of the parking bay 100, or any combination thereof.

At block 506, the tray 128 (having, in embodiments, the vehicle on the upper surface 152) is transported by the tray transportation mechanism (e.g., in embodiments, the AGV 136) from the tray-receiving opening 120 and through the AGV entrance 116 of the parking bay 100 (and, in embodiments, to, e.g., a parking space). In embodiments, once the one or more sensors 140 determine that the vehicle is properly parked on the tray 128 and the operator has exited the parking bay 100, the drive mechanism 135 may be operated to permit the tray 128 to be received on the AGV 136 and the overdrive platform 124 may be operated to move into the retracted position from the use position. Thus, in embodiments, the AGV 136 may be permitted to move the tray 128 and the vehicle on the tray 128 out of the parking bay 100 through the AGV entrance 116 and to a target parking space within the parking garage 118. It should be appreciated that a similar process is carried out in the reverse in instances in which the AGV 136 enters the parking bay 100 with a tray 128 carrying a vehicle or, alternatively, in instances in which a tray 128 is already present within the parking bay 100 and the AGV 136 enters the parking bay 100 to retrieve the tray 128.

From the above, it is to be appreciated that defined herein are parking apparatuses, parking systems, and methods for parking a vehicle using the parking apparatuses and parking systems described herein. The parking apparatuses and parking systems described herein generally include a parking bay including a sloped floor defining a tray-receiving opening and a tray positionable within the tray-receiving opening. The tray includes an upper surface configured to have a slope corresponding to a slope of the sloped floor when positioned within the tray-receiving opening. The systems may include drive mechanisms for orienting the tray and/or the sloped floor to align the tray and the sloped floor to be non-parallel with a ground on which the parking bay is provided.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A parking bay comprising:

a front wall comprising a front opening formed in the front wall and sized to accommodate a width of a vehicle;

a rear wall opposite the front wall, the rear wall comprising a rear opening formed in the rear wall and sized to accommodate the width of the vehicle;

a pair of side walls extending between the front wall and the rear wall; and a sloped floor provided between the front wall and the rear wall and defining a tray-receiving opening sized to contain a tray, wherein the sloped floor comprises an upper surface defining a slope between the front wall and the rear wall.

2. The parking bay of claim 1, wherein the sloped floor further comprises an entrance platform between the front wall and the tray-receiving opening.

3. The parking bay of claim 1, wherein the sloped floor further comprises an overdrive platform between the tray-receiving opening and the rear wall.

4. The parking bay of claim 3, wherein the overdrive platform is operable between a use position, wherein the overdrive platform is in line with the sloped floor, and a retracted position, wherein the overdrive platform is moved such that the rear opening is exposed.

5. The parking bay of claim 1, wherein the sloped floor further comprises a transition piece extending between the tray-receiving opening of the sloped floor and the side walls of the parking bay.

6. The parking bay of claim 1, further comprising a sensor, wherein:

the sensor detects at least one of:

a position of a vehicle within the parking bay;

a presence of a tray within the tray-receiving opening of the sloped floor; or an orientation of the tray within the tray-receiving opening of the sloped floor, and the sensor comprises at least one of an electronic sensor and a vision system.

7. The parking bay of claim 1, further comprising an indicator comprising a visual notification device, an audible notification device, or both, wherein the indicator is configured to provide an instruction to an operator of a vehicle entering the parking bay.

8. A parking system comprising:

a tray comprising a first upper surface sized to accommodate a vehicle;

a tray transportation mechanism comprising a lifting mechanism operable between a lowered position and a raised position, wherein, in the lowered position, the lifting mechanism does not engage the tray, and, in the raised position, the lifting mechanism extends to raise the tray; and a parking bay comprising:

a front wall comprising a front opening formed in the front wall and sized to accommodate a width of a vehicle;

a rear wall opposite the front wall, the rear wall comprising a rear opening formed in the rear wall and sized to accommodate the width of the vehicle;

a pair of side walls extending between the front wall and the rear wall; and a sloped floor provided between the front wall and the rear wall and defining a tray-receiving opening sized to contain the tray, wherein the sloped floor comprises a second upper surface defining a slope between the front wall and the rear wall.

9. The parking system of claim 8, wherein the tray transportation mechanism comprises an automated guided vehicle.

10. The parking system of claim 9, wherein the automated guided vehicle is an omnidirectional vehicle.

11. The parking system of claim 9, wherein the automated guided vehicle includes at least one of:

a navigation sensor;

a tray sensor;

a vision sensor; or a proximity sensor.

12. The parking system of claim 8, wherein the lifting mechanism is further operable in an intermediate position wherein the lifting mechanism engages or mates with the tray.

13. The parking system of claim 8, wherein:

the first upper surface of the tray comprises a tray slope; and the tray slope of the tray and the slope of the second upper surface of the sloped floor differ by less than or equal to 10 degrees.

14. The parking system of claim 8, wherein the tray includes a drive mechanism, wherein the drive mechanism adjusts a tray slope of the first upper surface of the tray.

15. The parking system of claim 8, wherein the sloped floor comprises a drive mechanism, wherein the drive mechanism engages the tray to adjust a tray slope of the first upper surface of the tray.

16. The parking system of claim 8, wherein:

the parking bay is positioned on a floor surface;

the sloped floor of the parking bay defines an angle relative to the floor surface; and the angle is greater than or equal to 0.5 degrees and less than or equal to 10 degrees.

17. The parking system of claim 8, further comprising a floor surface comprising indicia defining at least one of:

parking spaces on the floor surface; or one or more paths on the floor surface.

18. A method for orienting a tray within a parking bay on a slope, the method comprising:

positioning, by a tray transportation mechanism, a tray within a tray-receiving opening defined by a sloped floor of the parking bay and sized to contain the tray, wherein the sloped floor is provided between a front wall and a rear wall of the parking bay and wherein the tray enters the tray-receiving opening through a rear opening formed from the rear wall of the parking bay and sized to accommodate a width of a vehicle;

positioning a vehicle on an upper surface of the tray, wherein the vehicle enters the parking bay through a front opening formed from the front wall of the parking bay and sized to accommodate the width of the vehicle; and transporting, by the tray transportation mechanism, the tray from the tray-receiving opening and through the rear opening of the parking bay.

19. The method of claim 18, further comprising:

in response to receiving instruction that the vehicle desires to be parked, operating an overdrive platform of the parking bay to move into a retracted position to permit the tray transportation mechanism to position the tray within the parking bay; and in response to the tray being detected by a sensor of the parking bay, orienting, by a drive mechanism of the sloped floor, the tray to be sloped.

20. The method of claim 18, wherein the tray transportation mechanism is an automated guided vehicle.

* * * * *